US008974029B2

(12) United States Patent
Qiu et al.

(10) Patent No.: US 8,974,029 B2
(45) Date of Patent: Mar. 10, 2015

(54) INK-JET RECORDING APPARATUS AND PRINTING CONTROL METHOD

(71) Applicant: Hitachi Industrial Equipment Systems Co., Ltd., Chiyoda-ku, Tokyo (JP)

(72) Inventors: An Qiu, Hitachi (JP); Tsuneaki Takagishi, Hitachi (JP); Takashi Kawano, Tokaimura (JP); Nobuhiro Harada, Hitachi (JP); Shinichi Kobayashi, Hitachinaka (JP)

(73) Assignee: Hitachi Industrial Equipment Systems, Ltd., Tokyo (JP)

( * ) Notice: Subject to any disclaimer, the term of this patent is extended or adjusted under 35 U.S.C. 154(b) by 22 days.

(21) Appl. No.: 13/766,500

(22) Filed: Feb. 13, 2013

(65) Prior Publication Data

US 2013/0257949 A1 Oct. 3, 2013

(30) Foreign Application Priority Data

Mar. 30, 2012 (JP) ..... 2012-078876

(51) Int. Cl.
*B41J 29/38* (2006.01)
*B41J 2/045* (2006.01)
*B41J 2/105* (2006.01)

(52) U.S. Cl.
CPC ..... *B41J 2/04573* (2013.01); *B41J 2/105* (2013.01)
USPC ..... 347/14; 347/5; 347/9; 347/73; 347/74; 347/76; 347/77

(58) Field of Classification Search
CPC ..... B41J 2/02; B41J 2002/022; B41J 2/035
See application file for complete search history.

(56) References Cited

U.S. PATENT DOCUMENTS

| | | | |
|---|---|---|---|
| 4,394,663 | A | 7/1983 | Ameyama |
| 2009/0040283 | A1 | 2/2009 | Matsuda et al. |
| 2012/0086745 | A1 | 4/2012 | Moriai et al. |

FOREIGN PATENT DOCUMENTS

| | | | |
|---|---|---|---|
| CN | 102282022 | A | 12/2011 |
| EP | 2 447 074 | A1 | 5/2012 |
| JP | 1-168457 | A | 7/1989 |
| JP | 6-305125 | A | 11/1994 |

OTHER PUBLICATIONS

European Search Report Dated Jun. 21, 2013 {Five (5) Pages}.
Chinese Office Action dated Aug. 28, 2014, including partial English translation (seven (7) pages).

*Primary Examiner* — Justin Seo
(74) *Attorney, Agent, or Firm* — Crowell & Moring LLP

(57) ABSTRACT

An ink jet recording apparatus and printing control method are provided in which when a moving speed of a printing object is changed, a difference in writing start position is reduced and printing quality is improved. The apparatus includes an ink container, a nozzle connected to the container for ejecting ink, a charging electrode to charge the ejected ink, a deflecting electrode to deflect the charged ink, a gutter to collect ink not used for printing, a writing start timing control circuit to generate a first line clock signal, a printing width control circuit to generate a second line clock signal, and a control part. The control part controls print start timing based on the first clock signal, and when the printing object reaches the printing start timing, the control part performs a width adjustment of a character string of printing content based on the second clock signal.

20 Claims, 7 Drawing Sheets

INK-JET RECORDING APPARATUS AND PRINTING CONTROL METHOD

TECHNICAL FIELD

The present invention relates to an ink-jet recording apparatus to successively ejecting particulate ink from a nozzle and a printing control method thereof.

BACKGROUND ART

As a background art of this technical field, there is JP-A-6-305125 (Patent Literature 1). This publication discloses that a panel for inputting a unit movement amount of an encoder, a width of a printing object and a writing start position, and a panel interface circuit are provided, and a battery backup RAM stores the unit movement amount of the encoder, the width of the printing object and the writing start position, and software calculates the unit movement amount of the encoder (see Abstract).

Patent Literature 1: JP-A-6-305125

For example, in the related art ink-jet recording apparatus disclosed in Patent Literature 1, when a printing writing start position (position where a charged particle in the first printing scan impacts a printing object) is adjusted, the writing start position is adjusted by performing control to calculate moving speed from a previously inputted length of the printing object and a time in which the printing object passes through a sensor or by performing control to use an apparatus for generating a pulse with a frequency synchronizing with the moving speed of the printing object and to generate the pulse so that the width of a character becomes constant.

In the adjustment of the writing start position, the control is performed not only to a period from the pulse generation to the printing start timing (timing when a charging voltage is applied to the charged particle in the first printing scan), but also to a movement amount of the printing object during a period from the charging voltage application to the impact of the ink particle on the printing object. However, in the adjustment of the writing start position at this time, consideration is given to only a case where the moving speed is constant, and consideration is not given to a shift caused by acceleration or deceleration.

One of problems due to the change of the moving speed of the printing object is the shift of the printing writing start position, and there is a problem that the printing writing start position shifts backward when the moving speed is high as compared with the case where the moving speed is low.

In the related art, it is assumed that the moving speed of the printing object is constant. Thus, after the moving speed is calculated from the length of the printing object and the light-shielding time of the sensor, a line clock signal is generated based on only the moving speed, and the writing start position control is performed.

Thus, the line clock signal is generated based on only the speed at the time of measurement of the sensor, and a change in the writing start position due to a change in the moving speed between the sensor and the printing position after the generation of the line clock signal can not be dealt with, and the writing start position of a printing part is shifted.

SUMMARY OF INVENTION

An object of the invention is to provide an ink-jet recording apparatus and a printing control method, in which even when a moving speed of a printing object is accelerated or decelerated, a difference in writing start position is reduced and printing quality is improved.

In order to solve the problem, for example, the structure recited in the claims is adopted.

This application includes plural means for solving the problem and one example is such that an ink-jet recording apparatus includes an ink container to contain ink for printing a printing object, a nozzle that is connected to the ink container and ejects the ink, a charging electrode to charge the ink ejected from the nozzle and used for printing, a deflecting electrode to deflect the ink charged by the charging electrode, a gutter to collect ink not used for printing, a writing start timing control circuit to generate a first line clock signal, a printing width control circuit to generate a second line clock signal, and a control part, wherein the control part controls a writing start position to the printing object based on the first line clock signal, and when the printing object reaches a printing start timing, the control part adjusts a width of a character string of printing content based on the second line clock signal and performs printing control.

According to the invention, the ink-jet recording apparatus and the printing control method can be provided in which even when a moving speed is changed before a printing object reaches a printing position after passing through a sensor, a shift in printing writing start position can be reduced, and printing quality can be improved.

DESCRIPTION OF EMBODIMENTS

Hereinafter, embodiments will be described with reference to the drawings.

Embodiment 1

Figure 1:
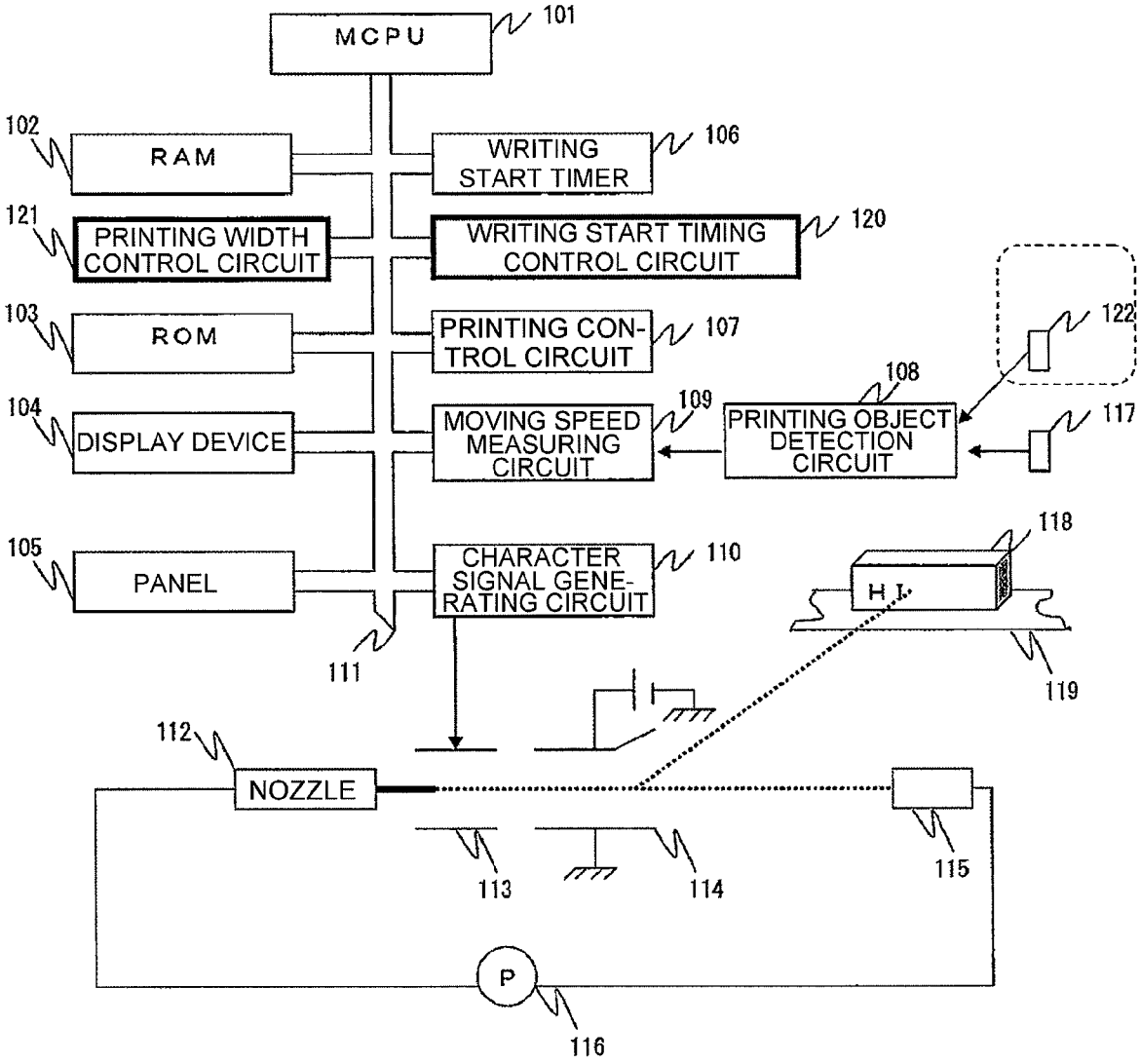
FIG. 1 is a structural view of an ink-jet recording apparatus of embodiment 1 of the invention.

FIG. 1 shows a structure of an ink-jet recording apparatus of an embodiment of the invention. A MPU (Micro Processing Unit) 101 controls the whole ink-jet recording apparatus. A RAM (Random Access Memory) 102 temporarily stores data in the ink-jet recording apparatus. A ROM (Read Only Memory) 103 stores software to calculate a writing start position and data. A display device 104 displays inputted data, printing content and the like. A panel 105 inputs the width of a printing object, a printing distance, a writing start position and the width of a printing character string.

A writing start timer 106 includes a counter and adjusts the timing of printing start. A printing control circuit 107 controls a printing operation of the ink-jet recording apparatus. A printing object detection circuit 108 detects a printing object. A moving speed measuring circuit 109 calculates a moving speed from the detection time of the printing object and the inputted length of the printing object. A writing start timing control circuit 120 generates a line clock signal for determining the timing of sending a character signal at the time of writing start from the measured moving speed. A printing width control circuit 121 generates a line clock signal for controlling so that the width of the printing character string becomes constant. A character signal generating circuit 110 converts the printing content into the character signal.

A bus line 111 sends data and the like, and a nozzle 112 ejects ink. A charging electrode 113 applies an electric charge to an ink particle formed of ink ejected from the nozzle. A deflecting electrode 114 deflects the charged ink particle. A gutter 115 collects ink not used for printing. A pump 116 again supplies the ink collected by the gutter to the nozzle. Sensors 117 and 122 detect a printing object. A printing object 118 is an object of printing, and a conveyor 119 conveys the printing object.

Next, a description will be made on the outline of a series of operations from the input of printing content to the completion of printing.

The printing content can be set in such a way that printing content data is inputted by the panel 105 and is stored in the RAM 102. Besides, a distance between vertical lines (movement distance per one pulse of a line clock signal) is determined from the width of a printing character string set by the panel 105 and is stored in the RAM 102.

A moving speed calculation program stored in the ROM 103 calculates the maximum printing speed of the printing content from the printing content set by the panel 105, a printing format and the distance between the vertical lines. Control is performed to align positions on the basis of a writing start position determined by the line clock signal generated with the maximum printing speed.

Figure 2:
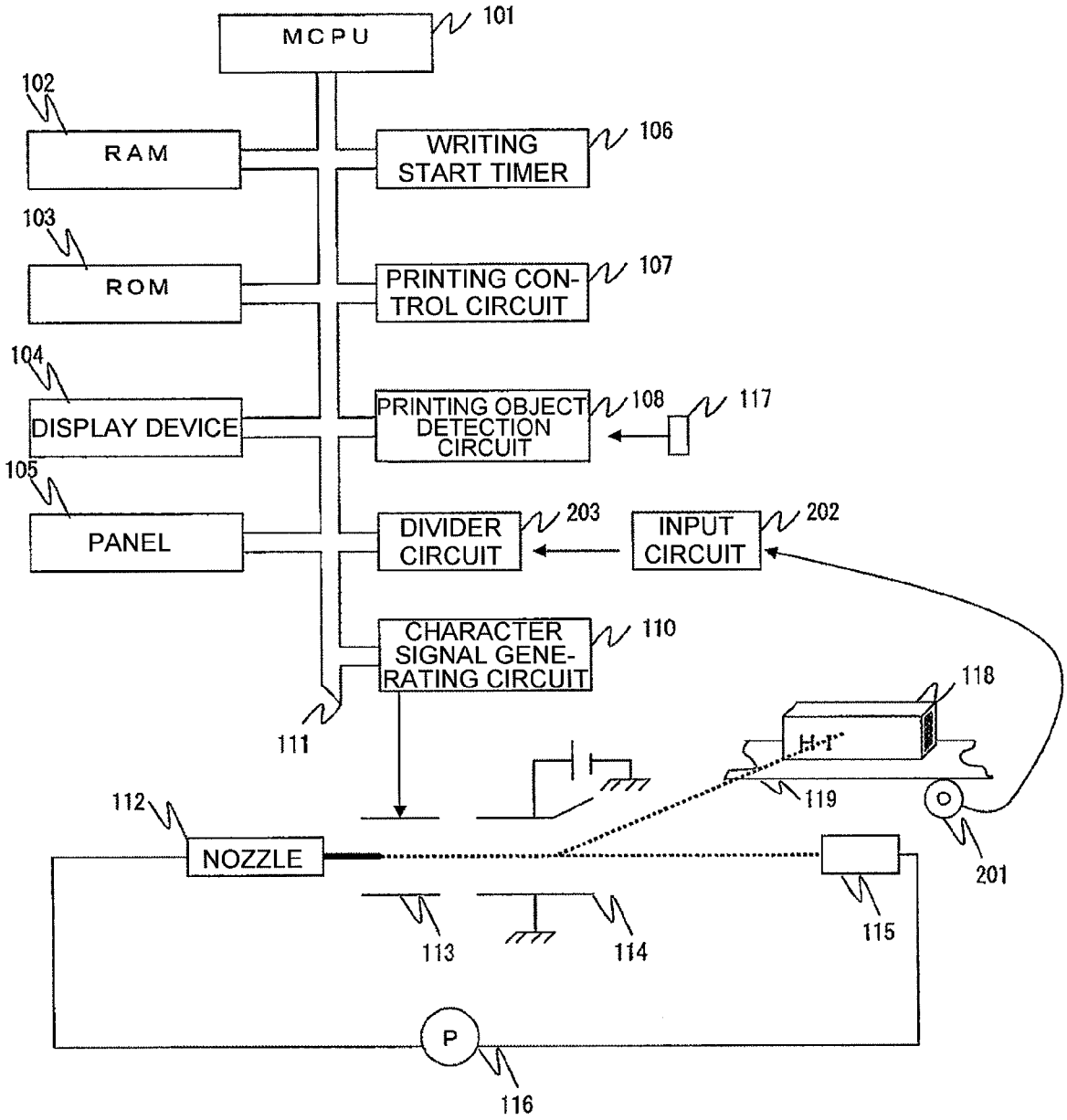
FIG. 2 is a structural view of the ink-jet recording apparatus to generate a line clock signal.
Figure 3:
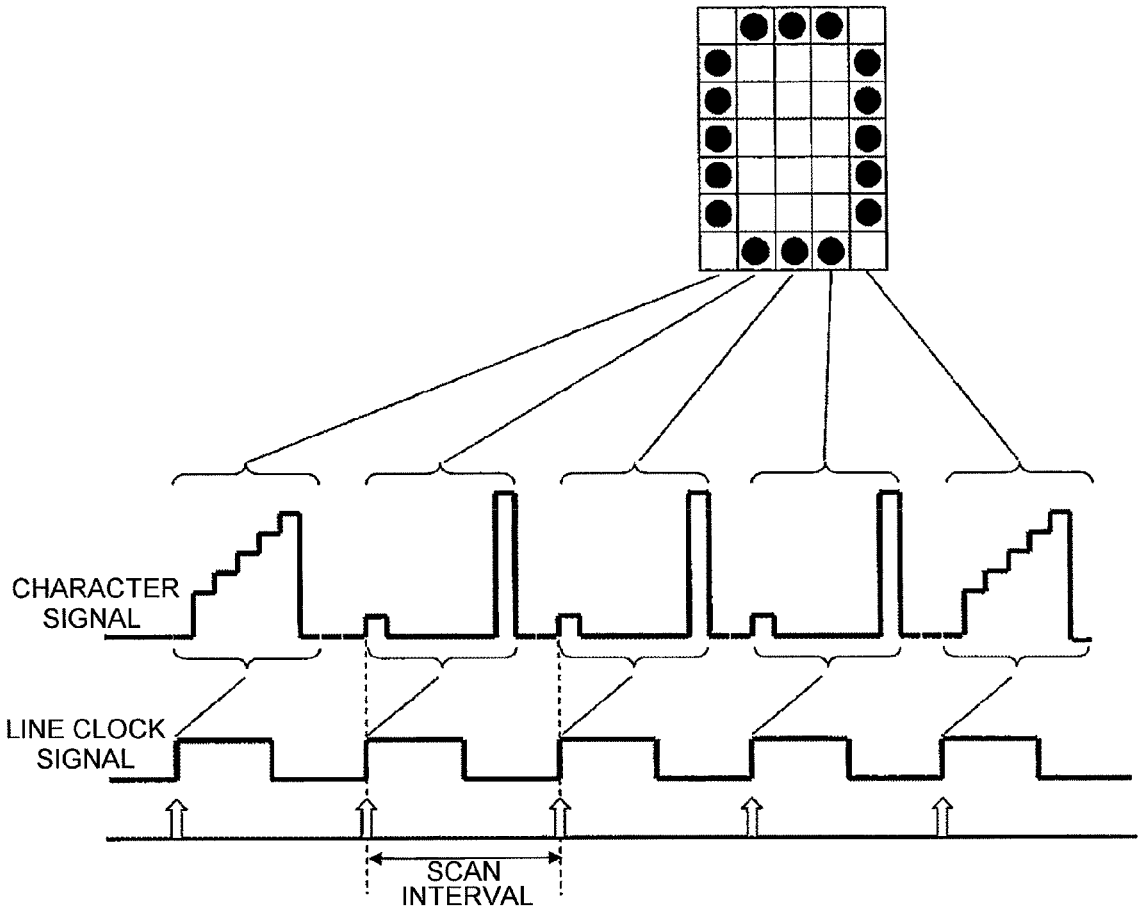
FIG. 3 is a view showing a relation between a line clock signal and a printing scan.
Figure 4:
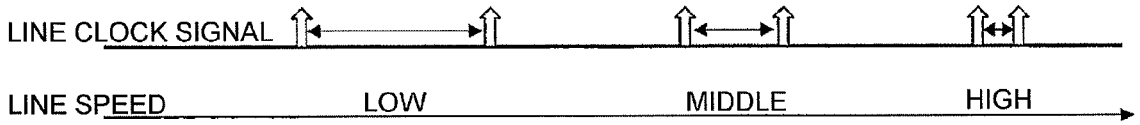
FIG. 4 is a view showing a relation between the width of a line clock signal and the moving speed of a printing object.

Here, the line clock signal will be described with reference to FIG. 2 to FIG. 4. FIG. 2 is a structural view of the ink-jet recording apparatus to generate the line clock signal, FIG. 3 is a view showing a relation between the line clock signal and a printing scan, and FIG. 4 is a view showing a relation between the width of the line clock signal and the moving speed of a printing object.

The line clock signal corresponds to a signal obtained in such a way that in a signal generating apparatus 201, such as a rotary encoder, for performing speed control in synchronization with the movement amount of a printing object, an external pulse is inputted to the apparatus by an input circuit 202, and the inputted external pulse is divided by a divider circuit 203.

When the signal generating apparatus is used, a timing when a character signal is generated is adjusted based on the divided signal, and printing is performed. A character signal shown in FIG. 3 corresponds to a character arrangement (dot pattern arrangement) for one vertical line of a printing character in which the character to be printed is expressed by a dot pattern, and has a pulse rising so as to correspond to the presence or absence of a dot at an up-and-down direction position for one vertical line. By this, as shown in FIG. 3, the line clock signal is a signal for generating a character signal of one scan (for one vertical line) per one pulse while the rising or falling of the pulse is made a trigger.

Printing control and writing start position control are performed so that the period of the line clock signal becomes a movement time per one scan, and becomes the length of an inputted printing character string. The moving speed of a printing object is known from the scan interval (period of the pulse) of the line clock signal. As shown in FIG. 4, as the scan interval becomes long, the moving speed of the printing object becomes low, and as the scan interval becomes short, the moving speed becomes high.

The line clock signal is generated as described below. First, when the printing object detection sensor 117 detects a printing object as a control object, the printing object detection circuit 108 measures a light-shielding time of the printing object. The moving speed measuring circuit 109 measures the moving speed of the printing object based on the length of the printing object set by the panel 105 and the measured light-shielding time.

Next, the line clock signal is generated based on the ratio of the moving speed of the printing object to the maximum printing speed determined at the time of setting. The generated line clock signal is stored in the RAM 102 through the bus line 111.

The number (1) of line clock pulses required from the printing object detection sensor 117 to the writing start can be calculated by dividing the distance from the printing object detection sensor 117 to the writing start by the stored distance between the vertical lines.

Besides, the movement amount of the printing object from the generation of the character signal generated by the character signal generating circuit 110 to the impact of the writing start particle to the printing object is calculated from the particle flying time obtained from the printing distance inputted by the panel 105 and the measured moving speed. The number (2) of line clock pulses is calculated by dividing the movement amount by the distance between the vertical lines.

The sum of the numbers (1) and (2) of the line clock pulses is made a counter value when the writing start timer 105 counts the number of pulses. The writing start timer 106 starts countdown from the counter value one by one in response to each pulse of the line clock signal. When the counter of the writing start timer 106 ends counting, a time-up instruction reaches the MPU 101 from the writing start timer 106.

When receiving the time-up instruction, the MPU 101 generates an instruction of printing start timing, and the MPU 101 sends the printing content stored in the RAM 102 to the character signal generating circuit 110 through the bus line 112.

The character signal generating circuit 110 converts the sent printing content into a character signal, and the charging electrode 113 applies a charging voltage corresponding to the character signal to ink particles formed of ink ejected from the nozzle 112.

The printing control circuit 107 controls the timing when the charging signal for performing the application control of the charging voltage is sent to the charging electrode 113 through the bus line 111. The ink particle charged by this control is deflected by the deflecting electrode 114, flies to the printing object 118 conveyed by the conveyor 119, and is adhered so that printing is performed. Ink particles not used for printing are collected by the gutter 115, and are again supplied to the nozzle 112 by the pump 116.

Figure 5A:
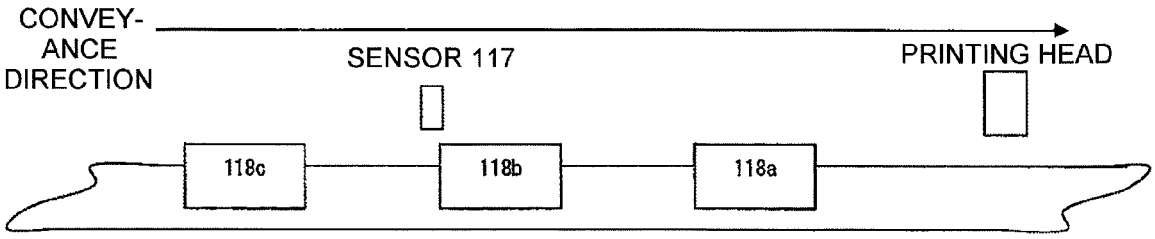
FIG. 5A is a view showing the conveyance of a printing object according to the invention when one printing object detection sensor is used.
Figure 5B:
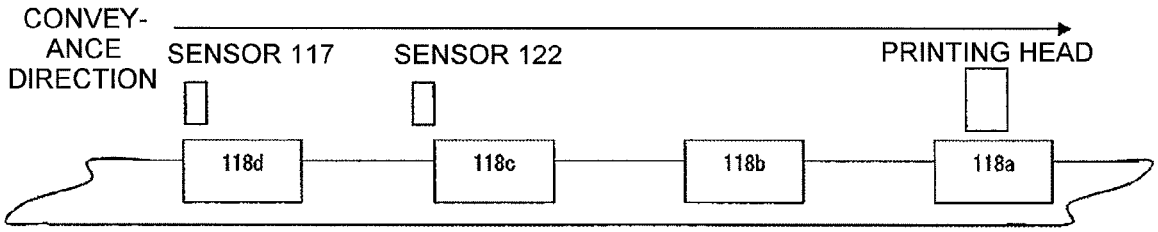
FIG. 5B is a view showing the conveyance of a printing object according to the invention when two printing object detection sensors are used.
Figure 6:
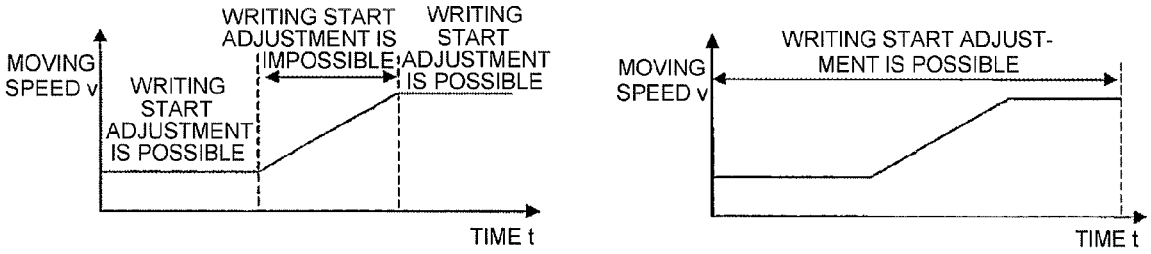
FIG. 6 is a comparative view of the related art and the invention in writing start control to a printing object.
Figure 7:
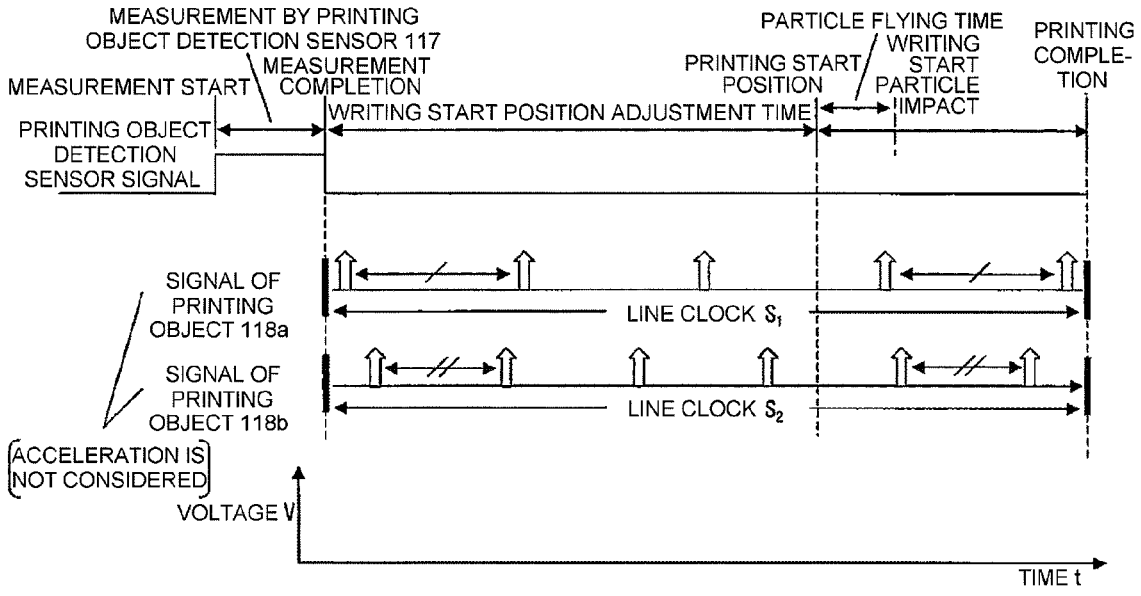
FIG. 7 is a time chart of line clock signal generation in the related art.
Figure 8:
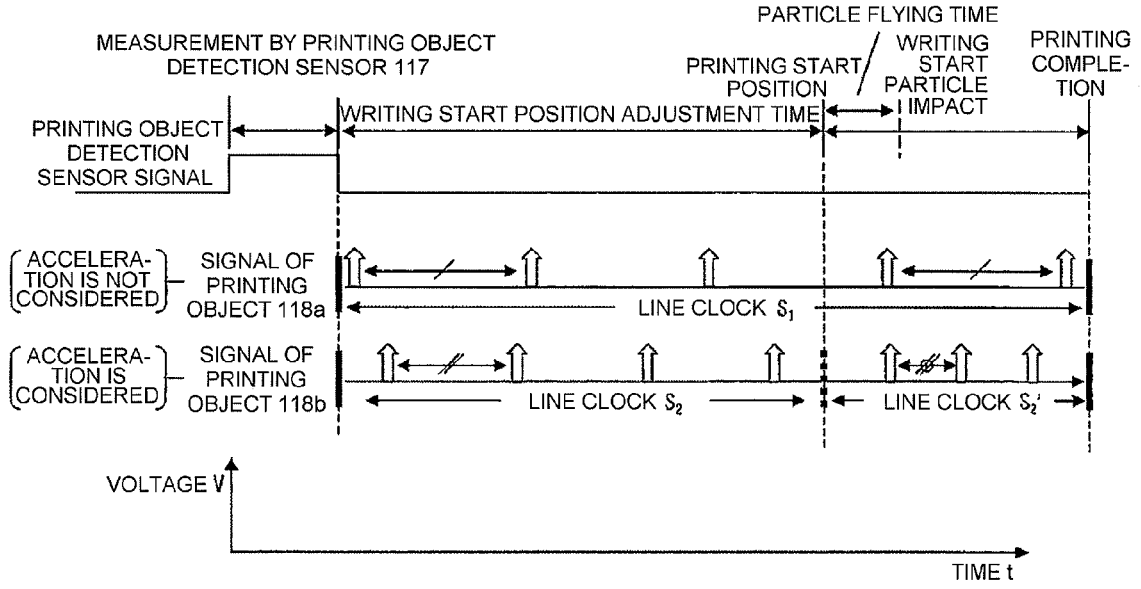
FIG. 8 is a time chart of line clock signal generation according to the invention when acceleration is obtained from moving speeds of two printing objects.
Figure 10:
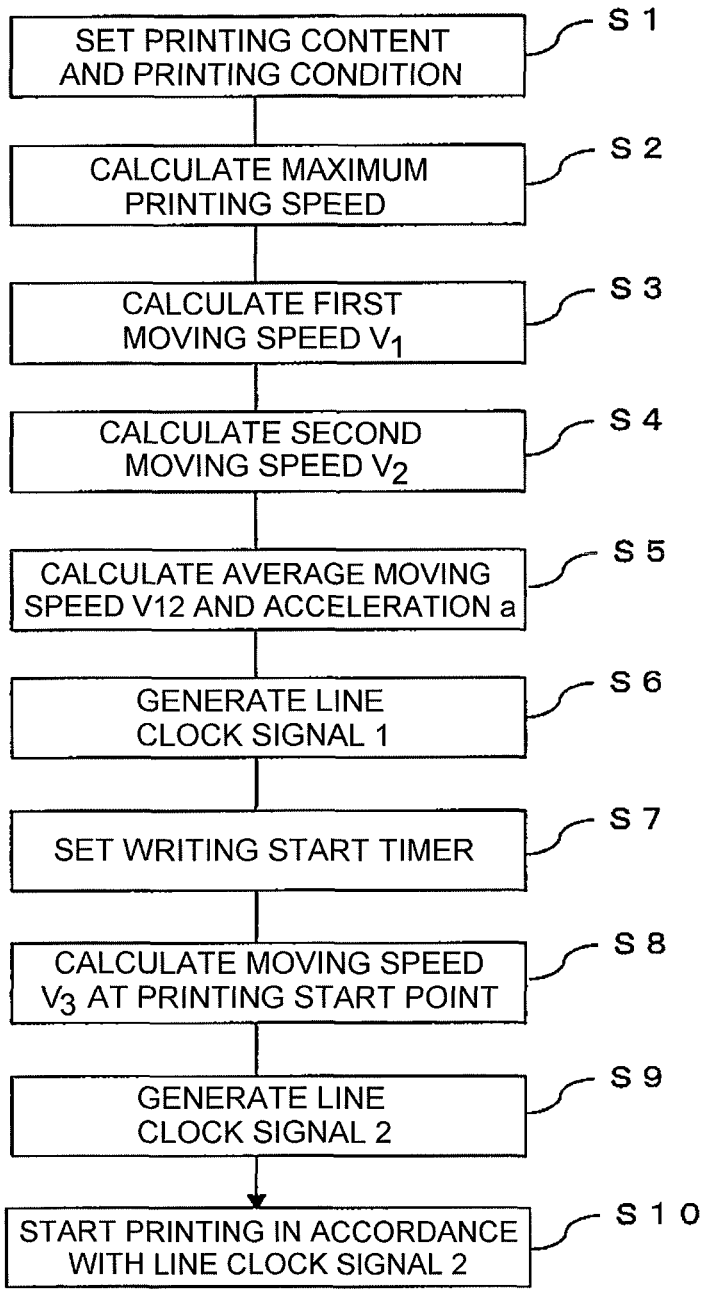
FIG. 10 is a flowchart of a control process of the invention.

A difference between the related art and the invention at the time of generation of a line clock signal will be described with reference to FIG. 5A to FIG. 8 and FIG. 10. FIG. 5A is a view showing printing object conveyance according to the invention when one printing object detection sensor is used. FIG. 5B is a view showing printing object conveyance according to the invention when two printing object detection sensors are used. FIG. 6 is a comparative view of the related art and the invention in writing start control to a printing object. FIG. 7 is a time chart of line clock signal generation in the related art. FIG. 8 is a time chart of line clock signal generation of the invention. FIG. 10 is a flowchart of a control process according to the invention.

The printing object 118 is conveyed as shown in FIG. 5A, that is, a printing object 118*a* is first conveyed, and then, a printing object 118*b*, a printing object 118*c* and the like are successively conveyed.

First, the related art will be described, while generation of line clock signals from passing of the printing object 118*a* through the printing object detection sensor 117 to completion of printing of the printing object 118*b* is shown in FIG. 7.

First, a line clock signal $S_1$ is generated which corresponds to a moving speed $V_1$ obtained from a measurement time when the printing object 118*a* passes through the printing object detection sensor 117. The printing object 118*a* is operated by the line clock signal $S_1$ after the measurement of the printing object detection sensor 117 until the completion of printing.

Next, a line clock signal $S_2$ is generated which corresponds to a moving speed $V_2$ obtained from a measurement time when the printing object 118*b* separated from the printing object 118*a* by a specific distance and conveyed thereafter passes through the printing object detection sensor 117. The printing object 118*b* is operated by the line clock signal $S_2$ after the measurement of the printing object detection sensor 117 until the completion of printing.

Line clock signal generation methods of the printing object 118*a* and the printing object 118*b* are the same, and a line clock signal for a printing object 118 conveyed after the printing object 118*b* is also generated by the same method.

At this time, in the related art, when the writing start position of the printing object 118*a* is calculated, the line clock signal is generated by using only the data measured when the printing object 118*a* passes through the printing object detection sensor 117. Thus, when the printing object 118*a* is accelerated or decelerated during the movement from the timing when the printing object passes through the printing object detection sensor 117 to the timing of printing start, the writing start position can not be adjusted. Accordingly, there is a problem that if the moving speed of the printing object is accelerated or decelerated, a shift occurs in the writing start position, and the printing quality is reduced. Similarly, also after the printing object 118*b*, the problem occurs if the moving speed of the corresponding printing object is accelerated or decelerated.

FIG. 6 shows the moving speed of the conveyor at a printing head part. The left side shows a graph of the related art, and the right side shows a graph of the invention. The drawing shows that even if the absolute value of the moving speed of a printing object varies, if the speed is not changed from the sensor measurement to the impact of writing start particles, the writing start position can be adjusted also by the related art, however, if the speed changes after the sensor measurement to the impact of writing start particles, the writing start adjustment can not be performed.

Next, the line clock signal generation of the invention will be described. Plural moving speed data stored in the RAM 102 are sent to the writing start timing control circuit 120 through the bus line 111, and the moving speed is calculated in view of acceleration.

The data of the line clock signal generated in response to the moving speed is set in the writing start timer 106 through the bus line 111. Hereinafter, the control of the writing start timing control circuit 120 in view of the acceleration will be described.

FIG. 10 shows the outline of a writing start printing control flowchart of the invention.

First, printing content and a printing condition are set (S1), and a maximum printing speed is calculated from the set values (S2). A first moving speed $V_1$ and a second moving speed $V_2$ of a printing object are calculated by an after-mentioned method (S3, S4), and an average moving speed $V_{12}$ and an acceleration "a" are obtained based on the first and second moving speeds (S5). By this, a first line clock signal is generated from the ratio of the average moving speed $V_{12}$ to the maximum printing speed (S6). The number of line clock pulses is calculated based on the first line clock signal, and is made a set value of a timer to count pulses (S7).

Further, a moving speed $V_3$ at a point of printing start to the printing object is calculated from the acceleration "a" (S8), and a second line clock signal is generated from the ratio of the moving speed $V_3$ to the maximum printing speed (S9). The time when the pulse count of the timer reaches the set number of line clock pulses is made a printing start timing, and printing is started in accordance with the second line clock signal (S10).

With respect to the calculation of the acceleration of the printing object in the flowchart of FIG. 10, two methods will be described below.

First, a case where the acceleration is obtained from moving speeds of two printing objects will be described. In this case, as shown in FIG. 5A, it is sufficient if one printing object detection sensor is provided in the conveyance path of the printing object. The generation of line clock signals from passing of the printing object 118*a* through the printing object detection sensor 117 to completion of printing of the printing object 118*b* will be described with reference to FIG. 8.

Since the acceleration of the first moving printing object 118*a* can not be calculated, a line clock signal for the printing object 118*a* is generated based on only the moving speed $V_1$ obtained from the measurement time for passing through the printing object detection sensor 117. The printing object 118*a* is operated by the line clock signal $S_1$ after the measurement of the printing object detection sensor 117 to the completion of printing.

Next, with respect to the printing object 118*b*, the acceleration is considered. Here, since moving speeds of two printing objects are required in order to obtain the acceleration, the moving speed $V_1$ and the moving speed $V_2$ of the printing object 118*a* and the printing object 118*b* at the time point of passing through the printing object detection sensor 117 are calculated. Here, the line clock signal generated based on the moving speed $V_1$ is made $S_1$. The acceleration of the printing object 118*b* is calculated from the moving speeds of the two printing objects and a time difference between the measurement times of the two printing objects measured by the printing object detection sensor from the position information of the printing object detection sensor detected by the printing object detection circuit 108.

Next, a moving speed $V_2'$ of the printing object 118*b* at the printing position can be calculated from the calculated acceleration and the moving speed $V_2$ of the printing object 118*b*. An average speed $V_2''$ between the printing object detection sensor 117 and the printing position is calculated from the speed $V_2$ at the position of the printing object detection sensor and the speed $V_2'$ at the printing position. The writing start timing control circuit 120 generates a line clock signal $S_2$ from the ratio of the average speed $V_2''$ to the maximum printing speed to enable printing with the printing content (determined width of a printing character string).

In order to suppress the change of the writing start position, the line clock signal $S_2$ is set in the writing start timer 106 until the printing object 118*b* moves to the printing position from the printing object detection sensor 117. When the counter ends counting, a writing start timer time-up instruction reaches the MPU 101. When the instruction reaches, the period is changed to that of a line clock signal $S_2'$, and control is performed from printing start to printing completion so that the change of the width of a printing character string is suppressed.

With respect to a printing object 118 conveyed after the printing object 118*b*, similarly to the printing object 118*b*, the acceleration is calculated from the moving speed of the former printing object, and a line clock signal capable of dealing with the acceleration or deceleration can be generated.

Figure 9:
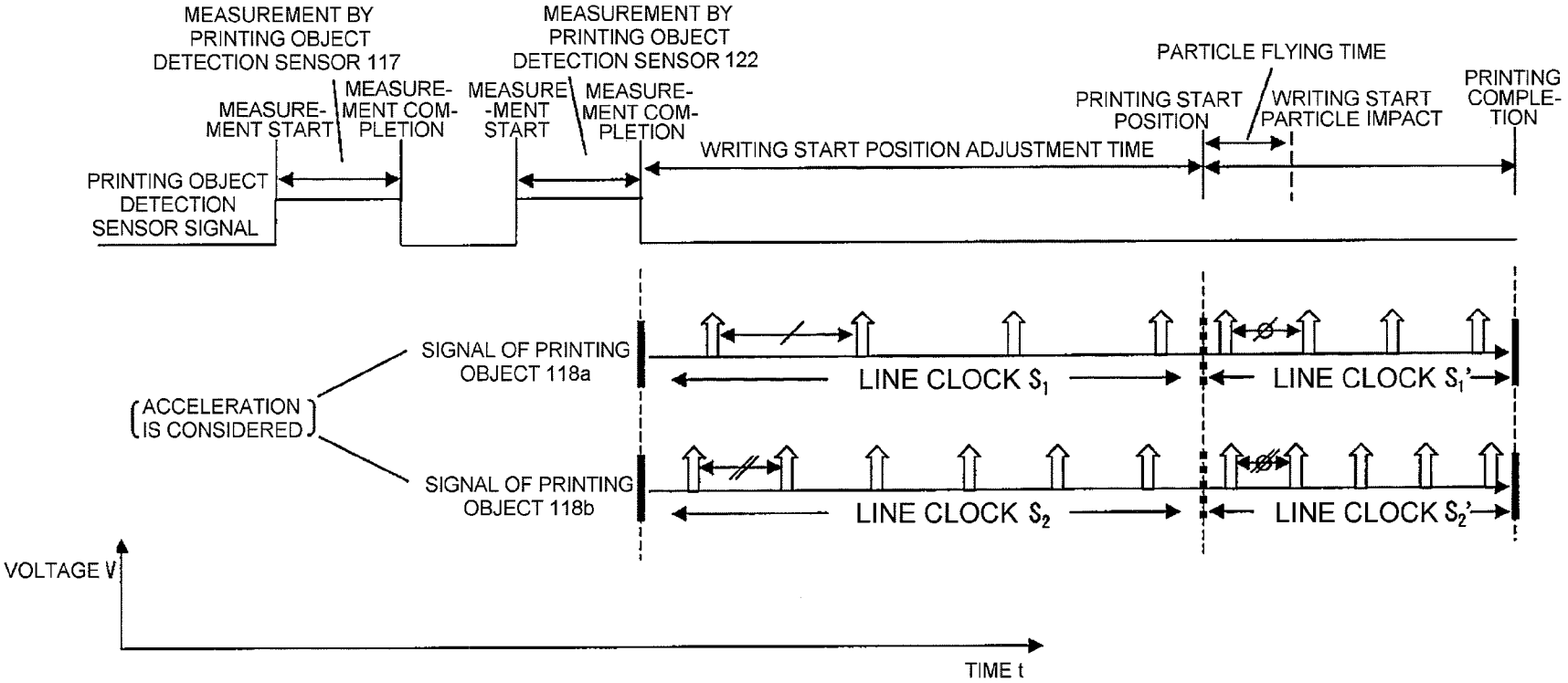
FIG. 9 is a time chart of line clock signal generation according to the invention when acceleration is obtained from moving speeds of a printing object measured by two sensors.

Next, a case where two sensors are used and acceleration is obtained from moving speed of a printing object will be described with reference to FIG. 9. In this case, the acceleration can be considered also for the first printing object. FIG. 9 shows a state during a period from a time when the printing object 118*a* passes through the printing object detection sensor 117 to a time when printing is completed.

In this case, as shown in FIG. 5B, it is assumed that two printing object detection sensors are provided in the conveyance path of a printing object. Since two printing object moving speeds are required in order to obtain acceleration, a moving speed $V_0$ and a moving speed $V_1$ at time points when one printing object 118*a* passes through the printing object detection sensor 117 and the printing object detection sensor 122 provided at two points are calculated. The acceleration is calculated from the two speeds and a time difference between the measurement times of the printing object measured by the two printing object detection sensors.

Next, a moving speed $V_1'$ of the printing object 118*a* at the printing position is calculated from the calculated acceleration. The printing width control circuit 121 generates a line clock signal $S_1'$ from the ratio of the moving speed $V_1'$ at the printing position to the maximum printing speed in the printing content.

An average speed $V_1''$ is calculated from the speed $V_1$ at the sensor position and the speed $V_1'$ at the printing position. The writing start timing control circuit 120 generates a line clock signal $S_1$ from the ratio of the average speed $V_1''$ to the maximum speed in the printing content. In order to suppress the change in the writing start position, the line clock signal $S_1$ is set in the writing start timer 106 until the printing object 118*a* moves to the printing position from the printing object detection sensor 122. When the counter ends counting, a writing start timer time-up instruction reaches the MPU 101. When the instruction reaches, the period is changed to that of a line clock signal $S_1'$, and control is performed from printing start to printing completion so that the change of the width of a printing character string is suppressed.

With respect to a printing object 118 conveyed after the printing object 118*a*, similarly to the printing object 118*a*, the acceleration is calculated from moving speeds of the printing object obtained by the two sensors, and a line clock signal in view of the acceleration can be generated.

According to the above embodiment, the ink-jet recording apparatus can be provided in which even when the printing object is accelerated or decelerated, printing can be performed while a shift in writing start position is suppressed, and printing quality can be improved.

What is claimed is:

1. An ink-jet recording apparatus comprising:

an ink container to contain ink for printing a printing object;

a nozzle that is connected to the ink container and ejects the ink;

a charging electrode to charge the ink ejected from the nozzle and used for printing;

a deflecting electrode to deflect the ink charged by the charging electrode;

a gutter to collect ink not used for printing;

a writing start timing control circuit to generate a first line clock signal;

a printing width control circuit to generate a second line clock signal; and a control part, wherein the control part controls a writing start position to the printing object based on the first line clock signal, and when the printing object reaches a printing start timing, the control part performs a width adjustment of a character string of printing content based on the second line clock signal and performs printing control.

2. The ink-jet recording apparatus according to claim 1, further comprising a detection part to detect a passing time of the printing object at a reference position, and a moving speed measuring circuit to calculate a moving speed of the printing object, wherein the moving speed measuring circuit calculates a moving speed of the printing object at a first point and a moving speed at a second point based on detection information obtained by the detection part, and an average moving speed is calculated from the first and second moving speeds, the writing start timing control circuit generates the first line clock signal based on a ratio of the average moving speed to a maximum moving speed of the printing object based on set information, the moving speed measuring circuit calculates an acceleration of the printing object based on the moving speed of the printing object at the first point, the moving speed at the second point, and a time required for the printing object to pass between the first and second points, and calculates a moving speed at the printing start timing based on the acceleration, and the printing width control circuit generates the second line clock signal based on a ratio of the moving speed at the printing start timing and the maximum moving speed of the printing object based on the set information.

3. The ink-jet recording apparatus according to claim 2, further comprising a plurality of the detection parts, wherein the moving speed measuring circuit calculates the moving speed of the printing object at the first point based on detection information of a first detection part, the moving speed measuring circuit calculates the moving speed of the printing object at the second point based on detection information of a second detection part, and the moving speed measuring circuit calculate the acceleration of the printing object based on the first and second moving speeds and a distance between the first and second points.

4. The ink-jet recording apparatus according to claim 2, wherein the moving speed measuring circuit calculates an acceleration of a second printing object based on a moving speed of a first printing object at the first point, a moving speed of the second printing object at the first point, and a time required for the printing object to pass between the first and second points, the moving speed measuring circuit obtains a moving speed of the second printing object at the printing start timing based on the acceleration, the second line clock signal is generated based on a ratio of the moving speed of the second printing object at the printing start timing and a maximum moving speed of the second printing object based on the set information, an average moving speed is calculated from the moving speed of the second printing object at the first point and the moving speed at the second point, the first line clock signal is generated based on the ratio of the average moving speed to the maximum moving speed of the printing object based on the set information, and the printing control of the second printing object is performed based on the first line clock signal and the second line clock signal.

5. The ink jet recording apparatus according to claim 1, further comprising a timer to count a pulse number, wherein the control part calculates a line clock pulse number by dividing a movement distance of the printing object until a printing start time from a position of a detection part by a movement distance per one pulse of the first line clock signal, the writing start timer counts the pulse number, and when a count value reaches the line clock pulse number, the control part starts printing.

6. The ink-jet recording apparatus according to claim 2, wherein the detection part is a sensor that detects the printing object and detects a passing time of the printing object.

7. The ink jet recording apparatus according to claim 2, wherein the detection part is an encoder that generates a signal based on a movement amount of the printing object.

8. A printing control method of an ink-jet recording apparatus including an ink container to contain ink for printing a printing object, a nozzle that is connected to the ink container and ejects the ink, a charging electrode to charge the ink ejected from the nozzle and used for printing, a deflecting electrode to deflect the ink charged by the charging electrode, a gutter to collect ink not used for printing, and a control part, the method comprising:

generating a first line clock signal and a second line clock signal based on a moving speed of the printing object;

controlling a writing start position to the printing object based on the first line clock signal; and performing a width adjustment of a character string of printing content based on the second line clock signal and performing printing control when the printing object reaches a printing start timing.

9. The printing control method of the ink-jet recording apparatus according to claim 8, wherein a passing time of the printing object at a reference position is detected by a detection unit;

a moving speed of the printing object is calculated from the passing time of the printing object and a set length of the printing object, an average moving speed is calculated from a moving speed of the printing object at a first point and a moving speed at a second point, the first line clock signal is generated based on a ratio of the average moving speed to a maximum moving speed of the printing object based on set information, an acceleration of the printing object is calculated based on the moving speed of the printing object at the first point, the moving speed at the second point, and a time required for the printing object to pass between the first and second points, a moving speed at the printing start timing is calculated based on the acceleration, and the second line clock signal is generated based on a ratio of the moving speed at the printing start timing and the maximum moving speed of the printing object based on the set information.

10. The printing control method of the ink-jet recording apparatus according to claim 9, wherein a plurality of the detection units are included, the moving speeds of the printing object at the first and second points are calculated based on detection information of a plurality of the detection units, and the acceleration of the printing object is calculated based on the first and second moving speeds and a time required for the printing object to pass between the first and second points.

11. The printing control method of the ink jet recording apparatus according to claim 9, wherein an acceleration of a second printing object is calculated based on a moving speed of a first printing object at the first point, a moving speed of the second printing object at the first point, and a time required for the printing object to pass between the first and second points, a moving speed of the second printing object at the printing start timing is obtained based on the acceleration, the second line clock signal is generated based on a ratio of the moving speed of the second printing object at the printing start timing and a maximum moving speed of the second printing object based on the set information, an average moving speed is calculated from the moving speed of the second printing object at the first point and the moving speed at the second point, and the first line clock signal is generated based on the ratio of the average moving speed to the maximum moving speed of the printing object based on the set information.

12. The printing control method of the ink jet recording apparatus according to claim 8, wherein a line clock pulse number is calculated by dividing a movement distance of the printing object until a printing start time from a time when the detection unit detects the printing object by a movement distance per one pulse of the first line clock signal, and the line clock pulse number is counted by a pulse counting unit and printing is started when a count value reaches the line clock pulse number.

13. The ink-jet recording apparatus according to claim 2, further comprising a timer to count a pulse number, wherein the control part calculates a line clock pulse number by dividing a movement distance of the printing object until a printing start time from a position of a detection part by a movement distance per one pulse of the first line clock signal, the writing start timer counts the pulse number, and when a count value reaches the line clock pulse number, the control part starts printing.

14. The ink-jet recording apparatus according to claim 3, further comprising a timer to count a pulse number, wherein the control part calculates a line clock pulse number by dividing a movement distance of the printing object until a printing start time from a position of a detection part by a movement distance per one pulse of the first line clock signal, the writing start timer counts the pulse number, and when a count value reaches the line clock pulse number, the control part starts printing.

15. The ink-jet recording apparatus according to claim 4, further comprising a timer to count a pulse number, wherein the control part calculates a line clock pulse number by dividing a movement distance of the printing object until a printing start time from a position of a detection part by a movement distance per one pulse of the first line clock signal, the writing start timer counts the pulse number, and when a count value reaches the line clock pulse number, the control part starts printing.

16. The ink-jet recording apparatus according to claim 3, wherein the detection part is a sensor that detects the printing object and detects a passing time of the printing object.

17. The ink-jet recording apparatus according to claim 4, wherein the detection part is a sensor that detects the printing object and detects a passing time of the printing object.

18. The ink-jet recording apparatus according to claim 5, wherein the detection part is a sensor that detects the printing object and detects a passing time of the printing object.

19. The ink-jet recording apparatus according to claim 3, wherein the detection part is an encoder that generates a signal based on a movement amount of the printing object.

20. The ink-jet recording apparatus according to claim 4, wherein the detection part is an encoder that generates a signal based on a movement amount of the printing object.

* * * * *